US009285114B2

(12) United States Patent
Tsumagari et al.

(10) Patent No.: US 9,285,114 B2
(45) Date of Patent: Mar. 15, 2016

(54) BURNER

(71) Applicants: HINO MOTORS, LTD., Tokyo (JP); SANGO CO., LTD., Aichi-ken (JP)

(72) Inventors: Ichiro Tsumagari, Tokyo (JP); Ryo Shibuya, Tokyo (JP); Makoto Tsujita, Tokyo (JP); Atsushi Koide, Miyoshi (JP)

(73) Assignees: HINO MOTORS, LTD., Tokyo (JP); SANGO CO., LTD., Aichi-ken (JP)

( * ) Notice: Subject to any disclaimer, the term of this patent is extended or adjusted under 35 U.S.C. 154(b) by 0 days.

(21) Appl. No.: 14/396,009

(22) PCT Filed: Sep. 25, 2013

(86) PCT No.: PCT/JP2013/075845
§ 371 (c)(1),
(2) Date: Oct. 21, 2014

(87) PCT Pub. No.: WO2014/073279
PCT Pub. Date: May 15, 2014

(65) Prior Publication Data

US 2015/0233575 A1 Aug. 20, 2015

(30) Foreign Application Priority Data

Nov. 6, 2012 (JP) ..... 2012-244765

(51) Int. Cl.
*F23D 11/02* (2006.01)
*F23D 11/44* (2006.01)
*F23K 5/20* (2006.01)

(52) U.S. Cl.
CPC ..... *F23D 11/445* (2013.01); *F23D 11/02* (2013.01); *F23D 11/448* (2013.01); *F23K 5/20* (2013.01)

(58) Field of Classification Search
CPC ..... F23D 11/02; F23D 11/445; F23D 11/448; F23K 5/20
USPC ..... 431/28, 208, 239, 258, 259
See application file for complete search history.

(56) References Cited

U.S. PATENT DOCUMENTS 2,225,869 A * 12/1940 Janitschek ..... 392/473
2,918,117 A * 12/1959 Griffin ..... 431/116

(Continued)

FOREIGN PATENT DOCUMENTS

DE 102009026266 2/2011
JP S58-83669 U 6/1983

(Continued)

OTHER PUBLICATIONS

International Search Report prepared by the Japanese Patent Office on Nov. 27, 2013, for International Application No. PCT/JP2013/075845.

(Continued)

*Primary Examiner* — Avinash Savani
*Assistant Examiner* — Deepak Deean
(74) *Attorney, Agent, or Firm* — Sheridan Ross P.C.

(57) ABSTRACT

A burner includes a tube, which includes a pre-mixing chamber that generates an air-fuel mixture containing fuel and a combustion chamber that burns the fuel. A first pipe supplies fuel, which is heated by an electric heater to the pre-mixing chamber. A second pipe includes a heat exchange unit that converts combustion heat of the fuel to vaporization heat of the fuel and supplies fuel heated by the heat exchange unit to the pre-mixing chamber. The second pipe is branched from the first pipe at a branched point, and the electric heater and the heat exchange unit are connected in parallel to the pre-mixing chamber.

9 Claims, 7 Drawing Sheets

(56) References Cited

U.S. PATENT DOCUMENTS

| | | | | |
|---|---|---|---|---|
| 3,653,794 | A * | 4/1972 | Shakiba | 431/208 |
| 3,768,958 | A * | 10/1973 | Sakai et al. | 431/208 |
| 4,008,041 | A * | 2/1977 | Roffe et al. | 392/397 |
| 4,538,413 | A * | 9/1985 | Shinzawa et al. | 60/303 |
| 6,540,505 | B1 | 4/2003 | Wuest et al. | |
| 2003/0232298 | A1 * | 12/2003 | Neufeldt | 431/247 |
| 2007/0113476 | A1 * | 5/2007 | Thomas et al. | 48/198.7 |

FOREIGN PATENT DOCUMENTS

| | | | |
|---|---|---|---|
| JP | 60-91120 | A | 5/1985 |
| JP | 60-91122 | A | 5/1985 |
| JP | 60-191112 | A | 9/1985 |
| JP | S62-204117 | U | 12/1987 |
| JP | S63-90719 | U | 6/1988 |
| JP | 64-000311 | A | 1/1989 |
| JP | H01-94720 | | 6/1989 |
| JP | 2-122106 | A | 5/1990 |
| JP | 7-190349 | A | 7/1995 |
| JP | 9-177568 | A | 7/1997 |
| JP | 10-306903 | A | 11/1998 |

OTHER PUBLICATIONS

Extended Search Report for European Patent Application No. 13852981.3, dated May 21, 2015, 5 pages.

* cited by examiner

BURNER

CROSS REFERENCE TO RELATED APPLICATIONS

This application is a national stage application under 35 U.S.C. 371 and claims the benefit of PCT Application No. PCT/JP2013/075845 having an international filing date of Sep. 25, 2013, which designated the United States, which PCT application claimed the benefit of Japanese Patent Application No. 2012-244765 filed Nov. 6, 2012, the disclosure of both the above-identified applications are incorporated herein by reference.

FIELD OF THE INVENTION

The technique of the present disclosure relates to a burner including an electric heater that vaporizes fuel.

BACKGROUND OF THE INVENTION

In a conventional exhaust purification device that purifies exhaust gas emitted from an engine, a burner heats fine particles, which are captured by a diesel particulate filter (DPF), and a catalyst. Pre-vaporization that heats and vaporizes fuel by using an electric heater is known as a method of supplying the fuel in such a burner (refer to, for example, patent document 1).

PRIOR ART DOCUMENT

Patent Document

Patent Document 1: Japanese Laid-Open Patent Publication No. 10-306903

SUMMARY OF THE INVENTION

In the method that heats and vaporizes fuel with the electric heater, drive power is used by the electric heater whenever the burner is driven. Thus, it is desirable that the amount of power used to drive the electric heater be reduced in the exhaust purification device that uses the burner.

It is an object of the technique of the present disclosure to provide a burner capable of reducing power consumption.

One aspect of the present disclosure is a burner including a combustion unit, a first supply unit, and a second supply unit. The combustion unit burns fuel. The first supply unit includes an electric heater, which heats fuel to be supplied to the combustion unit and supplies the fuel heated by the electric heater to the combustion unit. The second supply unit includes a heat exchange unit, which converts heat of the combustion unit to vaporization heat of the fuel. The second supply unit supplies the fuel heated by the heat exchange unit to the combustion unit. The electric heater and the heat exchange unit are connected in parallel to the combustion unit.

In the burner of one aspect of the present disclosure, the electric heater and the heat exchange unit are connected in parallel to the combustion unit. Thus, the fuel supplied to the combustion unit is the fuel heated by either the electric heater or the heat exchange unit. Hence, in the first supply unit, the electric heater need only be driven in accordance with the amount of fuel supplied by the first supply unit. This reduces the consumption of power used to drive the electric heater.

In a further aspect of the present disclosure, the burner includes a control unit that controls driving of the first supply unit and driving of the second supply unit. The control unit is configured to control the first and second supply units so that the first supply unit includes a condition in which the driving of the electric heater is stopped when the second supply unit supplies fuel.

In the burner of the further aspect of the present disclosure, when the second supply unit supplies the fuel, a condition in which the driving of the electric heater is stopped is included. This reduces the amount of power used to drive the electric heater compared to when the electric heater is continuously driven even when the second supply unit is supplying fuel.

In the burner of a further aspect of the present disclosure, the control unit includes a temperature acquisition portion, which acquires a temperature of the heat exchange unit, and a memory, which stores vaporization amount data that specifies a maximum value of a fuel amount vaporizable in the heat exchange unit in correspondence with the temperature of the heat exchange unit. When the maximum value corresponding to the acquired temperature is greater than or equal to a fuel amount supplied to the combustion unit, the control unit is configured to stop heating with the electric heater and to supply fuel with the second supply unit.

In the burner of the further aspect of the present disclosure, when the supply of fuel to the combustion unit may be performed with only the second supply unit, the heating of the fuel by the electric heater is stopped. Thus, compared to, for example, when the heating by the electric heater is stopped under the condition that the temperature of the heat exchange unit is higher than or equal to a predetermined temperature regardless of the fuel amount supplied to the combustion unit, the frequency in which the electric heater is stopped is increased. This further reduces the power amount used to drive the electric heater.

In the burner of a further aspect of the present disclosure, when the maximum value corresponding to the acquired temperature is smaller than the fuel amount supplied to the combustion unit, the control unit is configured to supply fuel with the second supply unit and supply fuel with the first supply unit.

In the burner of the further aspect of the present disclosure, within the fuel to be supplied to the combustion unit, the fuel of an amount vaporizable in the second supply unit is supplied to the second supply unit, and the remaining fuel is supplied to the first supply unit. Thus, compared to when the supply of fuel by the second supply unit is carried out when all the fuel to be supplied to the combustion unit can be vaporized in the second supply unit, the fuel amount heated by the electric heater is reduced. This reduces the power amount used to drive the electric heater.

In the burner of a further aspect of the present disclosure, the memory is configured to store power data in which the fuel amount vaporizable by the electric heater is specified in correspondence with the power of the electric heater. Further, the control unit is configured to drive the electric heater with the power corresponding to an amount of fuel supplied by the first supply unit.

In the burner of the further aspect of the present disclosure, the electric heater is driven with the power corresponding to the supply amount of the fuel by the first supply unit. As a result, compared to when the electric heater is driven with the same power regardless of the supply amount of the fuel by the first supply unit, the power used to drive the electric heater is reduced.

In the burner of a further aspect of the present disclosure, the combustion unit includes a tube that forms a circumferential wall of a combustion chamber, which is a void in which the fuel is burned. The heat exchange unit is attached to the tube and includes a heat receiving portion that is exposed in the combustion chamber to receive combustion heat of the fuel.

In the burner of the further aspect of the present disclosure, the heat receiving portion directly receives the combustion heat of the fuel. Thus, compared to when the heat receiving portion of the heat exchange unit contacts the tube without being exposed in the combustion chamber, the heat exchange unit is efficiently heated by the combustion heat.

In the burner of a further aspect of the present disclosure, the tube includes a basal end, which is supplied with fuel prior to burning, and a distal end, from which a combustion gas generated when burning the fuel flows out. The heat receiving portion includes a plurality of fins extending in a direction from the basal end toward the distal end and arranged next to each other in a circumferential direction of the tube.

In the burner of the further aspect of the present disclosure, the heat exchange unit is efficiently heated by the combustion heat since the fins are formed on the heat receiving portion. Furthermore, the fins extend in the direction from the basal end toward the distal end of the tube. Thus, gas can easily pass through a space between the fins. As a result, it is hard for the gas to stagnate in the space, and the heat exchange unit is efficiently heated by the combustion heat as compared to when fins extending in the circumferential direction of the tube are arranged next to one another in the direction from the basal end toward the distal end.

In the burner of a further aspect of the present disclosure, the combustion unit includes a tube that forms a circumferential wall of the combustion chamber, which is a void in which the fuel is burned. The heat exchange unit includes a tube passage that contacts the tube.

In the burner of the further aspect of the present disclosure, the fuel flowing through the tube passage receives the combustion heat of the fuel through the tube. Thus, the fuel can be heated in the tube passage.

In the burner of a further aspect of the present disclosure, the tube passage includes a portion spirally wound around the tube.

In the burner of the further aspect of the present disclosure, when connecting two points in the axial direction of the tube with the tube passage, the tube passage is elongated compared to when the two points are connected with a straight tube passage. This further increases the heat quantity received by the fuel flowing through the tube passage.

The burner of a further aspect of the present disclosure further includes an outer tube, into which the tube is inserted. Air is supplied to a gap formed by the outer tube and the tube.

In the burner of the further aspect of the present disclosure, air supplied to the gap between the outer tube and the tube is swirled around the tube when guided by the tube passage spirally wound around the outer surface of the tube. As a result, the air is heated by the tube, and the liquefaction of the fuel caused by mixing with the air is reduced.

In the burner of a further aspect of the present disclosure, the tube includes a plurality of intake holes that draw air into the combustion chamber. The intake holes are spirally laid out at a portion that does not contact the tube passage.

When the fuel is being burned, the circulating flow including the flame is generated in the vicinity of the opening of the second intake hole in the inner surface of the tube. The flame stabilizing effect is obtained by the circulating flow. In the structure described above, the second intake holes are formed at a plurality of positions in the axial direction of the tube in a spiral layout. The flame stabilizing effect is obtained at the plurality of positions in the axial direction of the tube. This improves the combustibility of the air-fuel mixture.

In the burner of a further aspect of the present disclosure, the tube includes a basal end, which is supplied with fuel prior to burning, and a distal end, from which the combustion gas generated when burning the fuel flows out. The combustion unit includes a partitioning portion that partitions an interior of the tube into a pre-mixing chamber, in which an air-fuel mixture of the fuel and air is generated, and a combustion chamber, in which the air-fuel mixture is burned. The partitioning portion includes an annular wall including an outer edge connected to an inner surface of the tube. A projecting tube projects from an inner edge of the wall toward the distal end of the tube. The projecting tube includes a closed end located closer to the distal end than the outer edge of the wall.

In the burner of a further aspect of the present disclosure, a portion of the pre-mixing chamber is surrounded by a portion of the combustion chamber. This increases the portion forming the circumferential wall of the combustion chamber in the tube, that is, the portion that directly receives the combustion heat of the fuel, as compared to when the pre-mixing chamber and the combustion chamber are arranged next to one another in the axial direction of the tube. This makes the layout of the tube passage more flexible when the tube passage of the heat exchange unit contacts the tube.

DETAILED DESCRIPTION OF THE PREFERRED EMBODIMENTS

A burner according to a first embodiment of the present disclosure will now be described with reference to FIGS. 1 to 8.

Figure 1:
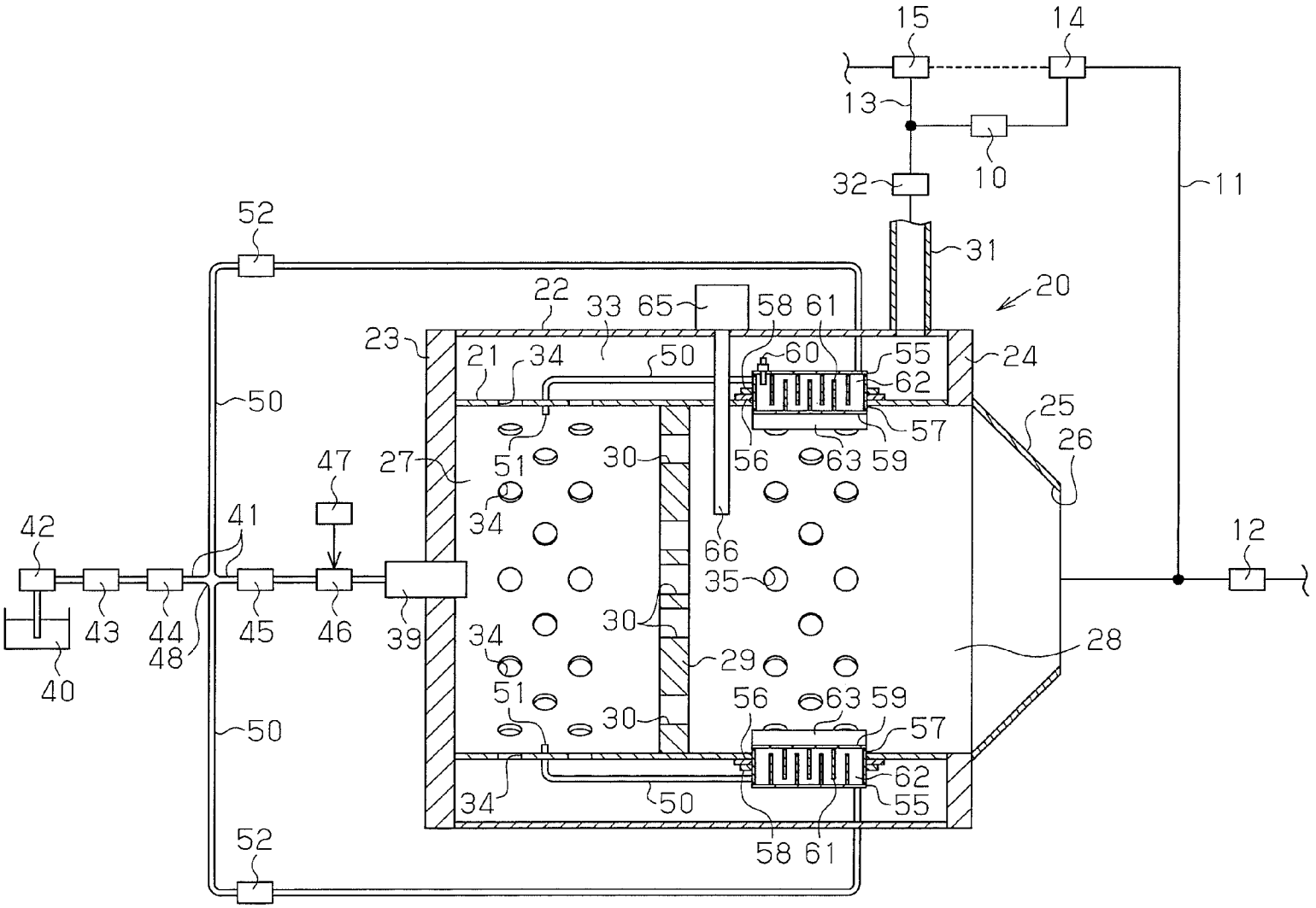
FIG. 1 is a schematic diagram showing the structure of a burner according to a first embodiment of the present disclosure.

As shown in FIG. 1, a DPF 12, which captures fine particles in exhaust gas, is set in an exhaust pipe 11 of a diesel engine 10. The DPF 12 has a honeycomb structure formed from, for example, porous silicon carbide so that fine particles of the exhaust gas are captured inside. A burner 20 is arranged at the upstream of the DPF 12. The burner 20 executes a regeneration process on the DPF 12 by raising the temperature of the exhaust gas flowing into the DPF 12.

The burner 20 has a double tube structure including a tube 21 and a tube 22 that are cylindrical in shape. The tube 21 is an element forming a combustion unit. The tube 22, which corresponds to an outer tube, has a larger inner diameter than the tube 21, which corresponds to an inner tube. A base plate 23 fixed to basal ends of the tubes 21 and 22 closes the open basal ends. An annular closing plate 24, which closes the gap between the tube 21 and the tube 22, is fixed to distal ends of the tubes 21 and 22. A substantially circular ring-shaped ejection plate 25 is connected to the closing plate 24, and an ejection port 26 is formed at the central portion of the ejection plate 25.

A partition wall 29 is attached to the tube 21 to partition the interior of the tube 21 into a pre-mixing chamber 27, which produces an air-fuel mixture, and a combustion chamber 28, which burns the air-fuel mixture. The partition wall 29 is a perforated circular plate, and the periphery of the partition wall 29 is joined with the inner circumferential surface of the tube 21. Connecting passages 30, which connect the pre-mixing chamber 27 and the combustion chamber 28, extend through the partition wall 29 in a thicknesswise direction.

A downstream end of an air supply pipe 31 is connected to the outer circumferential surface of the tube 22 at a location closer to the distal end than the partition wall 29. The air supply pipe 31 includes an upstream end connected to the downstream side of a compressor 15 in an intake pipe 13 of the engine 10. The compressor 15 rotates with a turbine 14 arranged in the exhaust pipe 11. An air valve 32, which is capable of varying the cross-sectional flow area of the air supply pipe 31, is arranged in the air supply pipe 31. When the air valve 32 is open, some of the intake air in the intake pipe 13 is supplied as combustion air to an air intake chamber 33, which is the gap between the tube 21 and the tube 22.

The circumferential wall of the tube 21 includes first intake holes 34 and second intake holes 35 formed throughout the circumferential wall in the circumferential direction. The first intake holes 34 are formed in the circumferential wall closer to the basal end than the partition wall 29 to connect the air intake chamber 33 and the pre-mixing chamber 27. The second intake holes 35 are formed in the circumferential wall closer to the distal end than the partition wall 29 to connect the air intake chamber 33 and the combustion chamber 28. In other words, the combustion air in the air intake chamber 33 is drawn into the pre-mixing chamber 27 through the first intake holes 34 and drawn into the combustion chamber 28 through the second intake holes 35.

An injection nozzle 39 that injects fuel into the pre-mixing chamber 27 is fixed to a central portion of the base plate 23. Some of the fuel in a fuel tank 40 is delivered to the injection nozzle 39 through a first pipe 41. The first pipe 41 is connected to a fuel pump 42, a fuel pressure sensor 43, a fuel temperature sensor 44, a first valve 45, and an electric heater 46. The fuel pump 42 is a mechanical pump that uses the engine 10 as a power source and incorporates a relief valve. The relief valve returns redundant fuel to the upstream side of the fuel pump 42 when a discharging pressure exceeds a maximum pressure Pfmax. The fuel pressure sensor 43 detects fuel pressure Pf, which is the pressure of the fuel flowing through the first pipe 41, and the fuel temperature sensor 44 detects a fuel temperature Tf, which is the temperature of the fuel flowing through the first pipe 41. The first valve 45 is a normally closed electromagnetic valve that is duty-controlled to open and close the first pipe 41. The electric heater 46 generates heat in accordance with the supplied power W, which is the power supplied from a power supply device 47, and heats the fuel flowing through the first pipe 41 to vaporize the fuel. The injection nozzle 39 injects the vaporized fuel from the electric heater 46 into the pre-mixing chamber 27. The supplied power W is the amount of power used to drive the electric heater 46, and is the consumed power of the electric heater 46.

Two second pipes 50, which are branched from a branched point 48 in the first pipe 41 between the fuel temperature sensor 44 and the first valve 45, are connected to the first pipe 41. The two second pipes 50 lead to the pre-mixing chamber 27 through different routes. One of the second pipes 50 extends from the upper side of the tube 22 into the air intake chamber 33 through a through hole (not shown) formed in the tube 22 at a location closer to the ejection port 26 than the partition wall 29. The other second pipe 50 extends from the lower side of the tube 22 into the air intake chamber 33 through a through hole (not shown) formed in the tube 22 at a location closer to the ejection port 26 than the partition wall 29. Each of the second pipes 50 extends through the air intake chamber 33 toward the base plate 23, where an injection nozzle 51 at a downstream end of each second pipe 50 is located in the pre-mixing chamber 27 through the first intake hole 34. Each of the second pipes 50 includes a normally closed second valve 52, which is a duty controlled electromagnetic valve that opens and closes the second pipe 50, and a heat exchange unit 55, which vaporizes the fuel that passes through the second valve 52.

The heat exchange unit 55, which is made of metal and is substantially box-shape, is fastened by screws (not shown) to an attaching base 56 fixed to the outer circumferential surface of the tube 21. The heat exchange unit 55 includes a main body 57, in which a fuel flow passage is formed, and an attaching flange 58, which is formed on the circumferential wall of the main body 57. The attaching flange 58 is fixed to the attaching base 56 with the main body 57 fitted into through holes formed in the attaching base 56 and the tube 21. A portion of the main body 57 exposed in the combustion chamber 28 directly receives combustion heat of the fuel burned in the combustion chamber 28. A heat exchange unit temperature sensor 60 is attached to the heat exchange unit 55 and serves as a temperature acquisition portion that detects the main body temperature Th, which is the temperature of the main body 57, in predetermined control cycles. A meandering flow passage 62 is formed by baffle plates 61 in the main body 57. The meandering flow passage 62 has a larger flow passage cross-sectional area than the second pipe 50.

Figure 2:
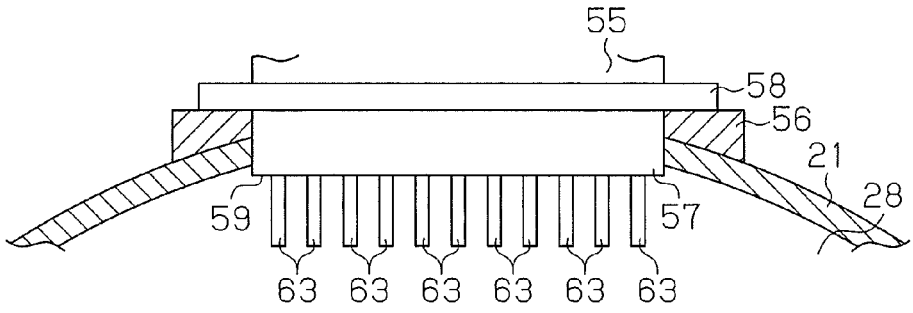
FIG. 2 is a front view showing the front structure of a heat exchange unit of FIG. 1.

FIG. 2 is a front view showing the front structure of the heat exchange unit, and is a front view showing a front structure of the heat exchange unit 55 as viewed from the side of the partition wall 29 in the axial direction of the tube 21. Further, as shown in FIG. 2, fins 63, which extend in the direction from the basal end toward the distal end of the tube 21, are formed on a heat receiving portion 59, which is the surface of the main body 57 facing the combustion chamber 28. The fins 63 are arranged spaced apart from one another in the circumferential direction of the tube 21. The heat exchange unit 55 vaporizes fuel by performing heat exchange between the combustion heat of the fuel burned in the combustion chamber 28 and the fuel flowing through the meandering flow passage 62.

More specifically, when the first valve 45 is open and the second valve 52 is closed, vaporized fuel is injected from the injection nozzle 39 into the pre-mixing chamber 27. When the first valve 45 and the second valve 52 are open, the vaporized fuel is injected from the injection nozzles 39 and 51 into the pre-mixing chamber 27. Further, when the first valve 45 is closed and the second valve 52 is open, the vaporized fuel is injected from the injection nozzles 51 into the pre-mixing chamber 27. In the pre-mixing chamber 27, the fuel injected from at least one of the injection nozzle 39 and the injection nozzles 51 is mixed with the combustion air drawn through the first intake hole 34 to produce an air-fuel mixture. A first supply unit includes the first pipe 41 at the downstream of the branched point 48, the first valve 45, the electric heater 46, the power supply device 47, and the injection nozzle 39. A second supply unit includes the second pipe 50 at the downstream of the branched point 48, the second valve 52, the heat exchange unit 55, and the injection nozzle 51.

Further, an igniting portion 66 of a spark plug 65 is arranged in the combustion chamber 28 closer to the partition wall 29 than the location where the second intake holes 35 are formed. The air-fuel mixture generated in the pre-mixing chamber 27 flows into the combustion chamber 28 through the connecting passages 30 in the partition wall 29 and is then ignited by the igniting portion 66. This burns the air-fuel mixture in the combustion chamber 28 and generates combustion gas, which is the burned air-fuel mixture. The generated combustion gas flows into the exhaust pipe 11 through the ejection port 26.

The electrical configuration of the burner 20 will now be described with reference to FIGS. 3 to 6.

A burner control unit 70 (hereinafter simply referred to as control unit 70) of the burner 20 controls the opening and closing of the first valve 45, the opening and closing of the second valve 52, the opening and closing of the air valve 32, the power supplied to the electric heater 46, and the ignition with the spark plug 65.

The control unit 70 includes a CPU, a ROM storing various types of control programs and various types of data, a RAM temporarily storing computation results of various computations and various types of data, and the like. Further, the control unit 70 executes various types of processes based on each control program stored in the ROM. An example of the operation of the burner 20 in a regeneration process, which incinerates the fine particles captured in the DPF 12, will now be described.

Figure 3:
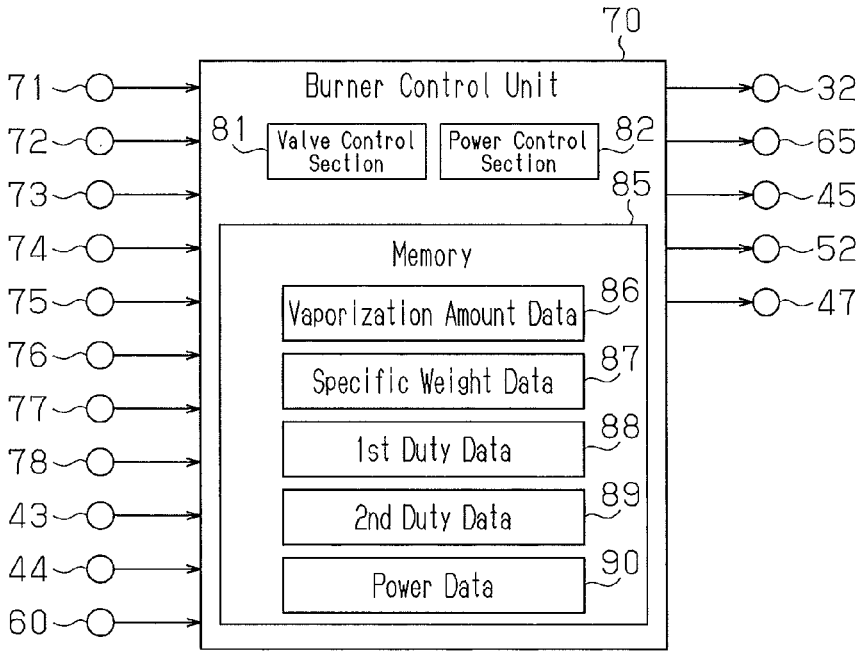
FIG. 3 is a functional block diagram showing the electrical configuration of the burner of FIG. 1.

As shown in FIG. 3, the control unit 70 receives a detection signal indicating the upstream side exhaust gas flow rate Qep1 from an upstream side exhaust gas flow rate sensor 71, a detection signal indicating the upstream side exhaust gas pressure Pep1 from an upstream side exhaust gas pressure sensor 72, and a detection signal indicating the upstream side exhaust gas temperature Tep1 from an upstream side exhaust gas temperature sensor 73 in predetermined control cycles. The control unit 70 also receives a detection signal indicating the DPF temperature Td from a DPF temperature sensor 74, a detection signal indicating the downstream side exhaust gas pressure Pep2 from a downstream side exhaust gas pressure sensor 75, and a detection signal indicating the intake air amount Qa from an intake air amount sensor 76 in predetermined control cycles. The control unit 70 further receives a detection signal indicating the air flow amount Qad from an air flow amount sensor 77, and a detection signal indicating an air temperature Tad from an air temperature sensor 78 in predetermined control cycles. The control unit 70 also receives a detection signal indicating the fuel pressure Pf from the fuel pressure sensor 43, a detection signal indicating the fuel temperature Tf from the fuel temperature sensor 44, and a detection signal indicating the main body temperature Th from the heat exchange unit temperature sensor 60 in predetermined control cycles.

The control unit 70 calculates the deposited amount M of the fine particles on the DPF 12 based on a pressure difference ΔP of the upstream side exhaust gas pressure Pep1 and the downstream side exhaust gas pressure Pep2, and the upstream side exhaust gas flow rate Qep1. The control unit 70 starts the regeneration process of the DPF 12 under the condition that the calculated deposited amount M is higher than a threshold α, which is set in advance.

When the deposited amount M of the fine particles calculated during the execution of the regeneration process becomes lower than a threshold β (<α), which is a threshold set in advance at which it may be determined that the fine particles deposited on the DPF 12 have been sufficiently incinerated, the control unit 70 terminates the regeneration process.

The control unit 70, which serves as a supply amount calculation unit, calculates the fuel supply amount Qfm, which is the mass flow rate per unit time of the fuel supplied to the pre-mixing chamber 27 based on the upstream side exhaust gas flow rate Qep1, the upstream side exhaust gas temperature Tep1, the air flow amount Qad, the air temperature Tad, the DPF temperature Td, and the target temperature of the DPF 12. The fuel supply amount Qfm is the fuel amount used to raise the temperature of the exhaust gas flowing into the DPF 12 and thereby raise the temperature of the DPF 12 to the target temperature. Further, the fuel supply amount Qfm is the amount of fuel supplied from the fuel tank 40 to the first pipe 41.

The control unit 70 calculates the air supply amount Qs corresponding to the fuel supply amount Qfm, that is, the amount of air per unit time used to burn the fuel of the fuel supply amount Qfm. The control unit 70 outputs, to the air valve 32, a valve opening signal, which is a control signal indicating the open degree of the air valve 32 that supplies air in correspondence with the air supply amount Qs to the burner 20 based on the intake air amount Qa, the air flow amount Qad, and the air temperature Tad. The air valve 32 receives the valve opening signal and is controlled at the open degree corresponding to the valve opening signal.

When the deposited amount M of the fine particles calculated during the execution of the regeneration process becomes lower than the threshold β, the control unit 70 outputs a valve closing signal, which is a control signal for closing the air valve 32, to the air valve 32. This interrupts the flow of intake air from the intake pipe 13 to the air supply pipe 31.

The control unit 70 outputs a control signal to the spark plug 65 to drive the spark plug 65. The spark plug 65 receives the control signal and generates a spark near the igniting portion 66. The control unit 70 also outputs a control signal to the spark plug 65 to stop driving the spark plug 65 when the deposited amount M of the fine particles calculated during the execution of the regeneration process becomes lower than the threshold β.

A valve control section 81 of the control unit 70 controls the opening and closing of the first valve 45 and each of the second valves 52. In the regeneration process, the control unit 70 executes a fuel supplying process that supplies the pre-mixing chamber 27 with an amount of fuel corresponding to the fuel supply amount Qfm. The valve control section 81 controls and closes the first valve 45 and the second valves 52 when the deposited amount M of the fine particles calculated during the execution of the regeneration process becomes lower than the threshold β.

In the fuel supplying process, the valve control section 81 calculates a vaporization amount Qfm2, which is the maximum value of the fuel that can be vaporized in each heat exchange unit 55 and is the mass flow rate per unit time, based on the main body temperature Th of the heat exchange unit 55, the fuel temperature Tf, and the vaporization amount data 86 stored in a memory 85.

Figure 4:
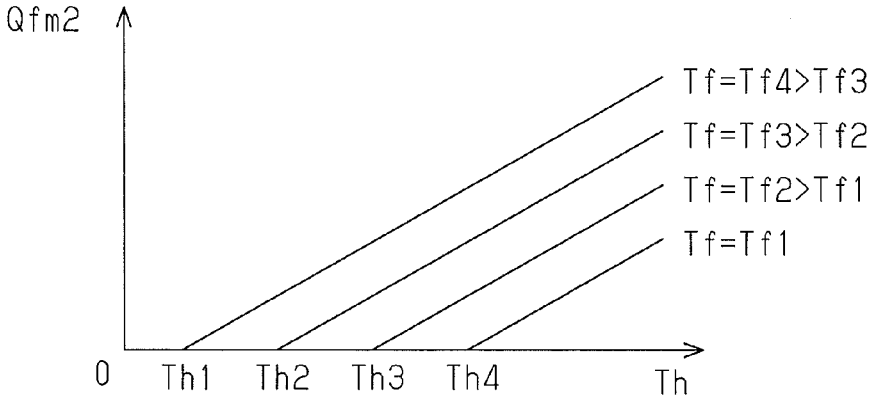
FIG. 4 is a schematic graph showing the vaporization amount data in the first embodiment.

As shown in FIG. 4, the vaporization amount data 86 is data based on experiments and simulations conducted in advance using fuel within a standard that is applicable to the engine 10. Further, the vaporization amount data 86 is the data specifying the vaporization amount Qfm2 of the fuel that can be vaporized in the heat exchange unit 55 of the main body temperature Th in correspondence with the fuel temperature Tf. As shown in FIG. 4, when the fuel temperature Tf is the same, the vaporization amount Qfm2 increases as the main body temperature Th rises. Further, the vaporization amount Qfm2 increases as the fuel temperature Tf rises even at the same main body temperature Th.

The valve control section 81 calculates the vaporization amount Qfm1, which is the mass flow rate per unit time of the fuel supplied to the electric heater 46, based on the fuel supply amount Qfm, the vaporization amount Qfm2, and the number of the heat exchange units 55. The vaporization amount Qfm1 corresponds to the fuel amount that is difficult to vaporize in the heat exchange unit 55 of the fuel supply amount Qfm. The vaporization amount Qfm1 calculated by the valve control section 81 corresponds to the fuel supply amount Qfm when the sum of the vaporization amount Qfm2 is "0 (zero)". The Qfm1 calculated by the valve control section 81 is "0 (zero)" when the sum of the vaporization amount Qfm2 is greater than or equal to the fuel supply amount Qfm.

The valve control section 81 calculates a volume flow rate Qfv1 converted from the vaporization amount Qfm1, which is a mass flow rate, and a volume flow rate Qfv2 converted from the vaporization amount Qfm2, which is a mass flow rate, based on the fuel temperature Tf and specific weight data 87. The specific weight data 87 is data in which the specific weight of the fuel is specified in correspondence with the fuel temperature Tf based on various standards related with fuel.

The valve control section 81 calculates the duty ratio D1 of the first valve 45 based on the volume flow rate Qfv1, the fuel pressure Pf, and the first duty data 88 stored in the memory 85. In the same manner, the valve control section 81 calculates the duty ratio D2 of the second valve 52 based on the volume flow rate Qfv2, the fuel pressure Pf, and the second duty data 89 stored in the memory 85.

Figure 5:
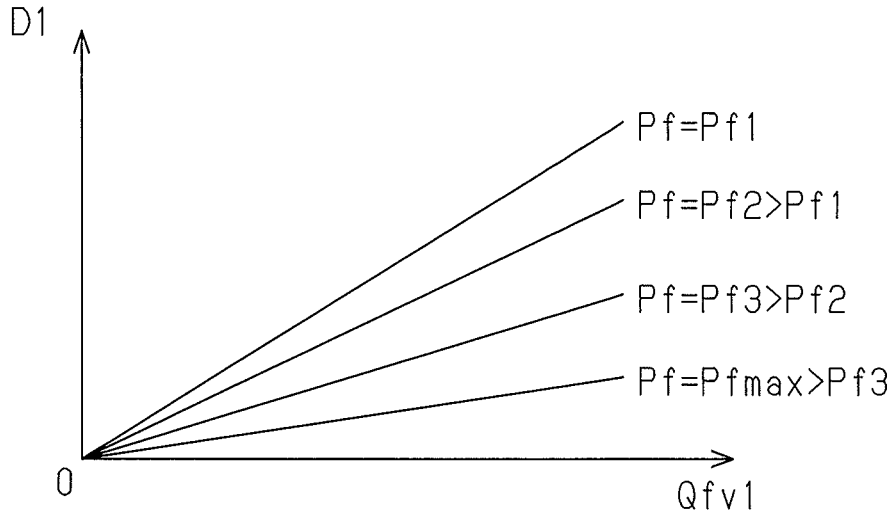
FIG. 5 is a schematic graph showing the first duty data in the first embodiment.

As shown in FIG. 5, the first duty data 88 is data in which the duty ratio D1 necessary for supplying the electric heater 46 with fuel at the volume flow rate Qfv1 is specified in correspondence with the fuel pressure Pf. As shown in FIG. 5, the first duty data 88 is specified to have a lower duty ratio D1 as the fuel pressure Pf increases even when the volume flow rate Qfv1 is the same. In the same manner as the first duty data 88 shown in FIG. 5, the second duty data 89 is data in which the duty ratio D2 necessary for supplying the heat exchange unit 55 with fuel at the volume flow rate Qfv2 is specified in correspondence with the fuel pressure Pf.

The valve control section 81 outputs a pulse signal corresponding to the duty ratio D1 to the first valve 45, and outputs a pulse signal corresponding to the duty ratio D2 to the second valves 52. Each of the valves 45 and 52 opens and closes in accordance with the input pulse signal. This supplies the electric heater 46 with fuel of the vaporization amount Qfm1, which is the mass flow rate. Further, fuel of the vaporization amount Qfm2, which is the mass flow rate, is supplied to each heat exchange unit 55. The burner 20 is designed so that the pre-mixing chamber 27 is supplied with the fuel of the fuel supply amount Qfm only through the first pipe 41.

In the fuel supplying process, a power control section 82 of the control unit 70 controls the power W supplied to the electric heater 46. The power control section 82 calculates the supplied power W based on the vaporization amount Qfm1 and the power data 90 stored in the memory 85, and controls the power supply device 47 so that the calculated supplied power W is supplied to the electric heater 46. The power control section 82 stops the power supply to the electric heater 46 when the deposited amount M of the fine particles calculated during the execution of the regeneration process becomes lower than the threshold β.

Figure 6:
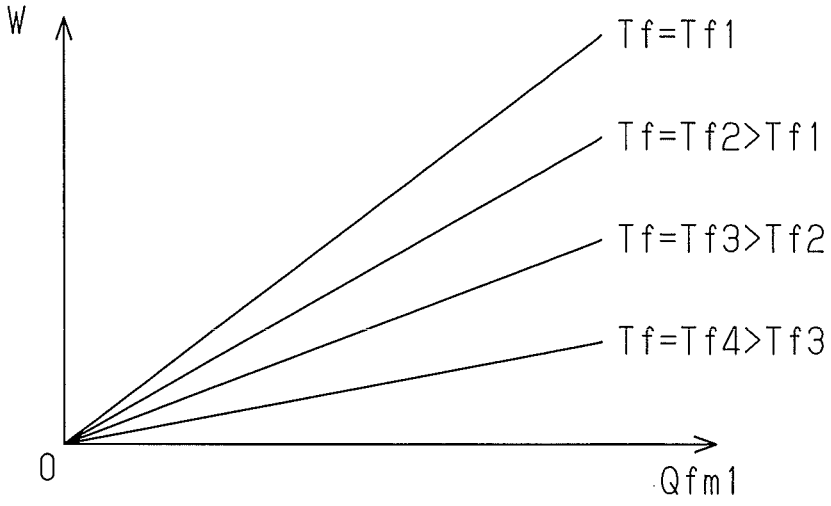
FIG. 6 is a schematic graph showing power data in the first embodiment.

As shown in FIG. 6, the power data 90 is data in which the vaporization amount Qfm1 and the supplied power W are associated with each other in correspondence with the fuel temperature Tf. The vaporization amount Qfm1 is the mass flow rate of the fuel supplied to the electric heater 46, and the supplied power W is the supplied power needed to vaporize the fuel corresponding to the vaporization amount Qfm1. The power control section 82 calculates the supplied power W based on the vaporization amount Qfm1 and the power data 90, and controls the power supply device 47 so that the supplied power W is supplied to the electric heater 46. For example, the power control section 82 calculates "0 (zero)" as the supplied power W when the vaporization amount Qfm1 is "0 (zero)," thereby stopping the power supply to the electric heater 46.

The procedures of the regeneration process executed by the control unit 70 will now be described with reference to FIG. 7.

Figure 7:
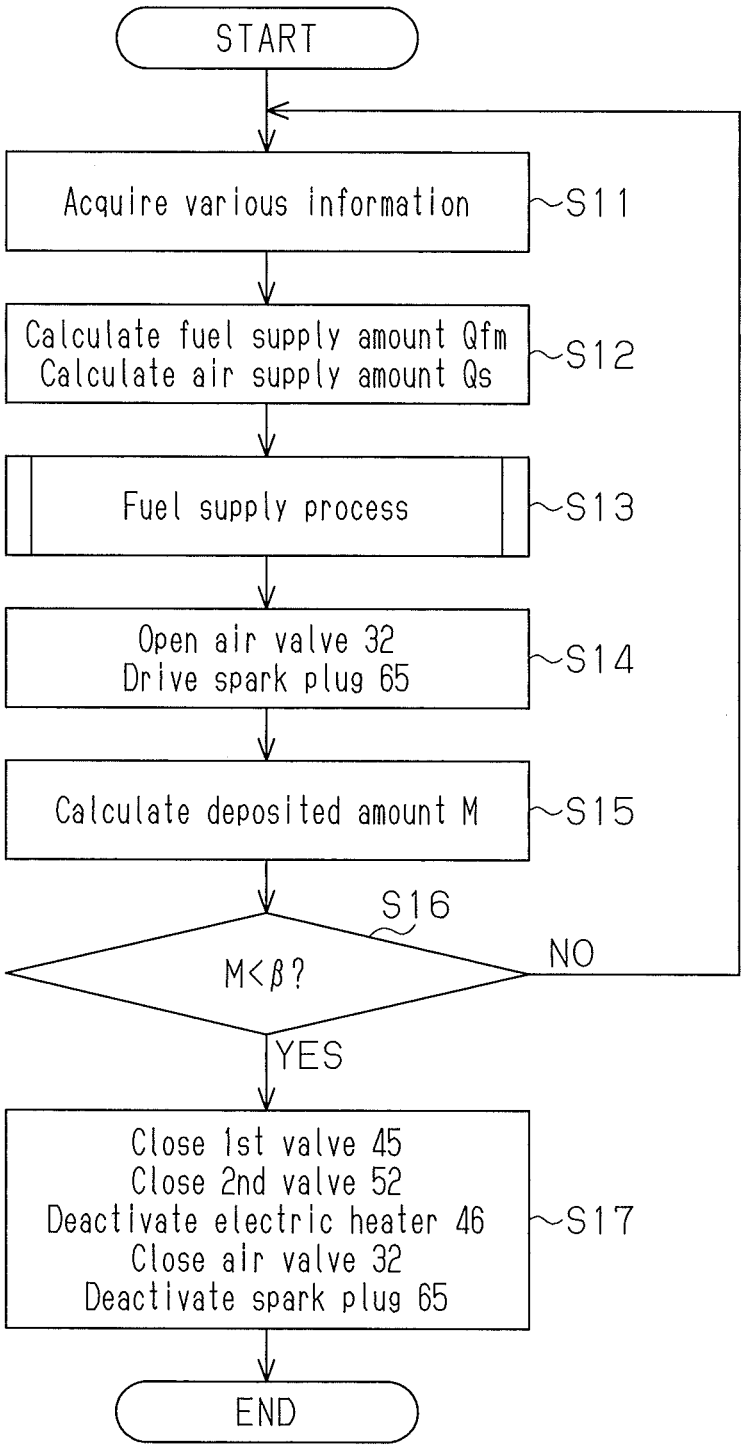
FIG. 7 is a flowchart showing the procedures of a regeneration process in the first embodiment.

As shown in FIG. 7, the control unit 70 acquires information used to execute the regeneration process from various sensors in step S11. In step S12, the control unit 70 calculates the fuel supply amount Qfm and the air supply amount Qs based on various information.

After executing the fuel supplying process in step S13, the control unit 70 opens the air valve 32 and drives the spark plug 65 in step S14. In step S15, the control unit 70 acquires the upstream side exhaust gas pressure Pep1, the upstream side exhaust gas flow rate Qep1, and the downstream side exhaust gas pressure Pep2 to calculate the deposited amount M. Then, in step S16, the control unit 70 determines whether or not the calculated deposited amount M is lower than the threshold β.

When the deposited amount M is greater than or equal to the threshold β (step S16: NO), the control unit 70 repeatedly executes the processes from step S11 to step S16. When the deposited amount M is lower than the threshold β (step S16: YES), the control unit 70 controls and closes the first valve 45, the second valve 52, and the air valve 32. In step S17, the control unit 70 stops driving the spark plug 65 and stops the power supply to the electric heater 46. Then, the control unit 70 ends the regeneration process.

The procedures of the fuel supplying process performed during the regeneration process will now be described with reference to FIG. 8.

Figure 8:
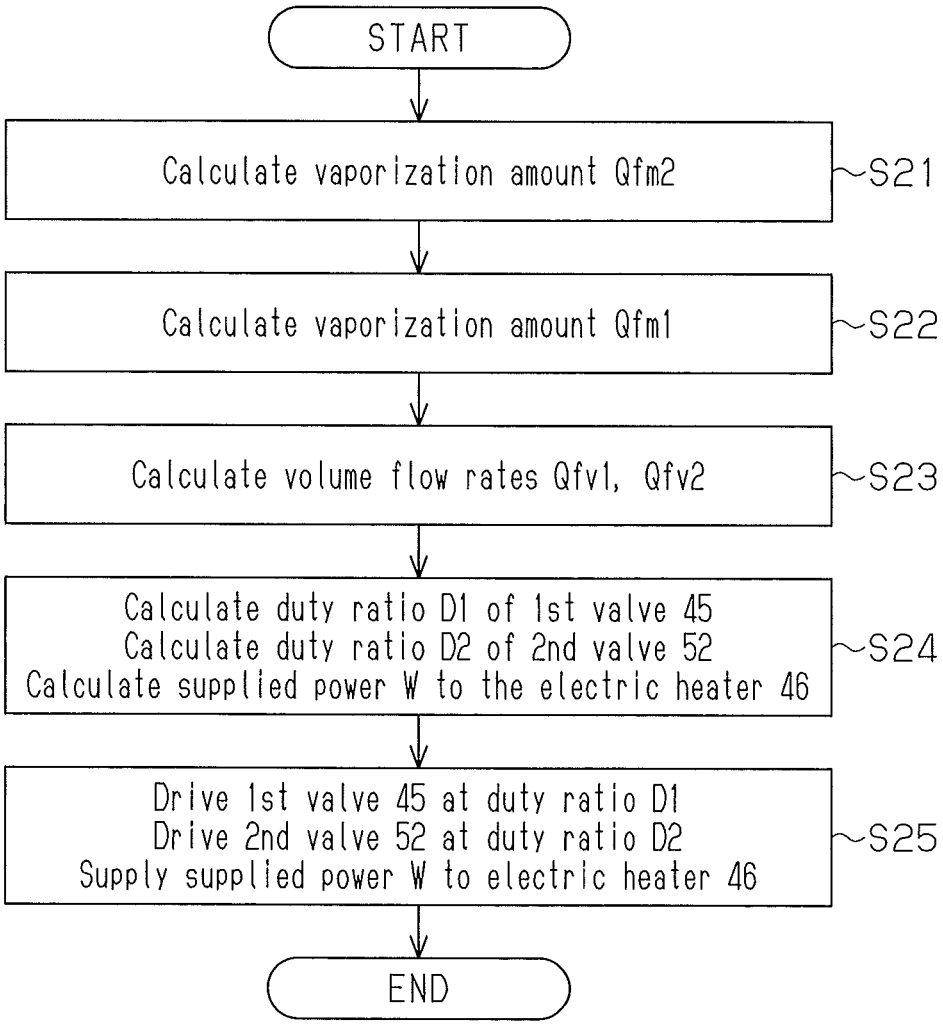
FIG. 8 is a flowchart showing the procedures of a fuel supplying process in the first embodiment.

As shown in FIG. 8, first, in step S21, the control unit 70 calculates the vaporization amount Qfm2 that may be vaporized in the heat exchange unit 55 based on the fuel temperature Tf, the main body temperature Th, and the vaporization amount data 86. Next, in step S22, the control unit 70 calculates the vaporization amount Qfm1 based on the fuel supply amount Qfm, the vaporization amount Qfm2, and the number of the heat exchange units 55.

Next, in step S23, the control unit 70 calculates the volume flow rates Qfv1 and Qfv2 that are obtained by converting the vaporization amounts Qfm1 and Qfm2, which are mass flow rates, to volume flow rates based on the vaporization amounts Qfm1 and Qfm2 and the specific weight data 87. Next, in step S24, the control unit 70 calculates the duty ratio D1 of the first valve 45 based on the volume flow rate Qfv1, the fuel pressure Pf, and the first duty data 88, and calculates the duty ratio D2 of the second valve 52 based on the volume flow rate Qfv2, the fuel pressure Pf, and the second duty data 89. The control unit 70 calculates the power W supplied to the electric heater 46 based on the fuel temperature Tf, the vaporization amount Qfm1, and the power data 90.

Next, in step S25, the control unit 70 drives the first valve 45 at the duty ratio D1. The control unit 70 drives the second valve 52 at the duty ratio D2. The control unit 70 controls the power supply device 47 so that the supplied power W is supplied to the electric heater 46. This ends the fuel supplying process. The pre-mixing chamber 27 is supplied with the vaporized fuel of the vaporization amount Qfm1 from the injection nozzle 39 and the vaporized fuel of the vaporization amount Qfm2 from the injection nozzle 51.

The operation of the burner 20 described above will now be described.

In the burner 20 described above, the electric heater 46 is located in the first pipe 41, and the heat exchange unit 55 is arranged in the second pipe 50. The second pipe 50 is branched from the branched point 48 of the first pipe 41 at the upstream side of the electric heater 46. In other words, the electric heater 46 and the heat exchange unit 55 are connected in parallel to the pre-mixing chamber 27, which is formed by the tube 21. The first valve 45 that controls the fuel supplied to the electric heater 46 is located in the first pipe 41, and the second valve 52 that controls the fuel supplied to the heat exchange unit 55 is located in the second pipe 50.

The fuel supplied to the pre-mixing chamber 27 is thus heated by either the electric heater 46 or the heat exchange unit 55. Since the electric heater 46 need only be driven in accordance with the fuel amount supplied to the electric heater 46, the consumed power of the electric heater 46 is reduced.

If the electric heater were to be arranged in the heat exchange unit, the fuel that flows through the heat exchange unit would exchange heat with the heat exchange unit and also with the electric heater. Thus, when the electric heater is deactivated, the electric heater would absorb the heat of the heat exchange unit and the fuel, which are heated by the combustion heat.

In this regard, the burner 20 is controlled so that the second valve 52 opens when fuel may be vaporized in the heat exchange unit 55. This vaporizes at least some of the fuel supplied from the fuel tank 40 to the first pipe 41 in the heat exchange unit 55. The vaporized fuel is then supplied to the pre-mixing chamber 27 without exchanging heat with the electric heater 46.

In this manner, heat exchange is not performed between the fuel flowing through the heat exchange unit 55 and the electric heater 46. Since the fuel flowing through the heat exchange unit 55 does not exchange heat with the electric heater 46, the heat exchange unit 55 and the fuel are efficiently heated by the combustion heat. This effectively vaporizes fuel in the heat exchange unit 55.

The heat exchange unit 55 is set in the burner 20 by attaching the attaching flange 58 to the attaching base 56 with the main body 57 fitted into the through holes formed in the tube 21 and the attaching base 56. In other words, the heat exchange unit 55 may be set in the burner 20 as long as the attaching base 56 is arranged on the tube 21 and the through holes for fitting the main body 57 are formed in the tube 21 and the attaching base 56. As the number of the heat exchange units 55 set in the burner 20 increases or decreases, the fuel amount that may be supplied to the pre-mixing chamber 27 also increases and decreases. Thus, the burner output may be changed while limiting enlargement of the burner by forming a plurality of the attaching bases 56 on the tube 21 and changing the set number of the heat exchange units 55 accordingly.

In the burner 20 described above, based on the main body temperature Th, the fuel temperature Tf, and the vaporization amount data 86, in the fuel supply amount Qfm, the amount of fuel that the heat exchange unit 55 is able to vaporize is supplied to the heat exchange unit 55. The remaining fuel is supplied to the electric heater 46. If the fuel of the fuel supply amount Qfm may be vaporized with only the heat exchange unit 55, the first valve 45 is controlled to close and the electric heater 46 is deactivated.

Thus, compared to when power is continuously supplied to the electric heater 46 regardless of whether the first valve 45 and the second valve 52 are open or closed, the consumed power of the electric heater 46 is reduced for an amount corresponding to the deactivation of the electric heater 46.

Further, compared to the case in which the main body temperature Th is fixed when the first valve 45 is controlled to close regardless of the fuel supply amount Qfm, the frequency the electric heater 46 is deactivated is increased. As a result, the consumed power of the electric heater 46 is further reduced.

The fuel of an amount that the heat exchange unit 55 is able to vaporize is supplied to the heat exchange unit 55. Thus, compared to when fuel is supplied to the heat exchange unit 55 only when the sum of the vaporization amount Qfm2 is greater than or equal to the fuel supply amount Qfm, the vaporization of fuel using the combustion heat of the fuel is efficiently performed and the consumed power of the electric heater 46 is reduced.

When the fuel temperature Tf changes, the heat quantity used to vaporize fuel also changes. Thus, when the vaporization amount Qfm2 relative to the main body temperature Th is constant regardless of the fuel temperature Tf, the fuel temperature Tf used as a reference for setting the vaporization amount Qfm2 needs to be lowered. When using the vaporization amount data generated under such condition to calculate the vaporization amount Qfm2, the frequency increases in which the actual fuel temperature Tf becomes higher than the fuel temperature Tf, which is the reference. Thus, there is a tendency of the heat exchange unit 55 being supplied with less fuel than the amount that can be actually vaporized. This results in inefficient fuel vaporization in the heat exchange unit 55 and also increases the consumed power of the electric heater 46.

In this regard, the vaporization amount data 86 specifies the vaporization amount Qfm2, which corresponds to the main body temperature Th, in correspondence with the fuel temperature Tf. In other words, the vaporization amount Qfm2 specified in the vaporization amount data 86 is the fuel amount suitable for the present fuel temperature Tf and main body temperature Th when vaporizing fuel in the heat exchange unit 55. As a result, fuel is efficiently vaporized in the heat exchange unit 55, and the consumed power of the electric heater 46 is also reduced.

In the burner 20 described above, the supplied power W of the electric heater 46 is set based on the fuel temperature Tf, the vaporization amount Qfm1, and the power data 90. That is, the electric heater 46 is supplied with only the power needed to vaporize the fuel of the vaporization amount Qfm1. Thus, compared to when the supplied power is fixed when the electric heater 46 is driven, the consumed power of the electric heater 46 is reduced. Since the power data 90 also specifies the supplied power W in correspondence with the fuel temperature Tf, fuel is efficiently vaporized in the electric heater 46.

The main body 57 of the heat exchange unit 55 is partially exposed in the combustion chamber 28 through the through holes formed in the tube 21 and the attaching base 56. That is, the main body 57 of the heat exchange unit 55 directly receives the combustion heat of the fuel. Thus, compared to when the main body 57 of the heat exchange unit 55 indirectly receives the combustion heat through the circumferential wall of the tube 21, the heat exchange unit 55 is efficiently heated by the combustion heat. As a result, the temperature of the heat exchange unit 55 is easily raised after the regeneration process starts so that fuel may be readily vaporized in the heat exchange unit 55. This further reduces the consumed power of the electric heater 46.

In the main body 57 of the heat exchange unit 55, the heat receiving portion 59 includes the fins 63 that directly receive the fuel heat. Thus, compared to when the heat receiving portion 59 does not include the fins 63, the surface area of the heat receiving portion 59 increases, and the heat exchange unit 55 is efficiently heated by the combustion heat.

In the combustion chamber 28, the combustion gas flows toward the ejection port 26 in the direction from the basal end toward the distal end of the tube 21. Each fin 63 extends in the direction from the basal end toward the distal end of the tube 21 and lies along the flowing direction of the combustion gas. Thus, compared to when the fins extend in the circumferential direction of the tube 21 and are arranged next to one another in the direction from the basal end toward the distal end of the tube 21, gas easily passes through the space between the fins 63 when the air-fuel mixture is burned. As a result, this limits the gas that remains in the space, and further efficiently heats the heat exchange unit 55 with the combustion heat of the fuel.

As described above, the density of fuel differs in accordance with the fuel temperature Tf. Thus, even if, for example, the first valve 45 is controlled at the same duty ratio D1, the mass flow rate of the fuel passing through the first valve 45 differs in accordance with the fuel temperature Tf. In this regard, the duty ratio of each of the valves 45 and 52 is set after converting the mass flow rate to the volume flow rate based on the specific weight data 87 in the burner 20. In other words, the duty ratios D1 and D2 of the valves 45 and 52 are set taking into consideration the fuel temperature Tf in the burner 20. This decreases the difference of the fuel amount actually supplied to the electric heater 46 and the vaporization amount Qfm1, which is the calculated value, and the difference of the fuel amount actually supplied to the heat exchange unit 55 and the vaporization amount Qfm2, which is the calculated value. As a result, the accuracy is increased for the fuel amount supplied to the electric heater 46 and the heat exchange unit 55. This increases the ratio of the vaporized fuel in the fuel supplied to the pre-mixing chamber 27. Thus, the ignitability and the combustibility of the air-fuel mixture are improved.

As described above, the burner 20 of the first embodiment has the advantages described below.

(1) The electric heater 46 and the heat exchange unit 55 are connected in parallel to the pre-mixing chamber 27. Thus, the electric heater 46 only needs to be driven in accordance with the fuel amount supplied to the electric heater 46. This reduces the consumed power of the electric heater 46.

(2) Since heat is not exchanged between the fuel flowing through the heat exchange unit 55 and the electric heater 46, the fuel in the heat exchange unit 55 is effectively vaporized.

(3) The number of the set heat exchange units 55 may be changed so that the burner output is variable while limiting enlargement of the burner 20.

(4) The electric heater 46 is deactivated when the first valve 45 is closed. As a result, compared to when the electric heater 46 is continuously supplied with power regardless of whether the first valve 45 is open or closed, the consumed power of the electric heater 46 is reduced.

(5) The amount of fuel supplied to the heat exchange unit 55 is changed in accordance with the fuel supply amount Qfm and the main body temperature Th of the heat exchange unit 55. Thus, compared to the case in which the main body temperature Th is fixed when the first valve 45 is controlled to close regardless of the fuel supply amount Qfm, the frequency the electric heater 46 is deactivated is increased. As a result, the consumed power of the electric heater 46 is further reduced.

(6) The heat exchange unit 55 is supplied with the amount of fuel the heat exchange unit 55 is able to vaporize. This efficiently vaporizes fuel with the combustion heat of the fuel, and reduces the consumed power of the electric heater 46.

(7) In the vaporization amount data 86, the vaporization amount Qfm2 corresponding to the main body temperature Th is specified in correspondence with the fuel temperature Tf. This efficiently vaporizes fuel in the heat exchange unit 55, and reduces the consumed power of the electric heater 46.

(8) The supplied power W of the electric heater 46 is changed in accordance with the vaporization amount Qfm1. Thus, the consumed power of the electric heater 46 is reduced compared to when the power supplied to the electric heater 46 is constant.

(9) The power data 90 specifies the supplied power W corresponding to the fuel temperature Tf. This efficiently vaporizes fuel with the electric heater 46 while reducing the consumed power in the electric heater 46.

(10) The heat receiving portion 59, which is a portion of the main body 57, is exposed in the combustion chamber 28. Thus, the heat exchange unit 55 directly receives combustion heat. As a result, the heat exchange unit 55 readily vaporizes fuel. This further reduces the consumed power of the electric heater 46.

(11) The fins 63 are formed in the heat receiving portion 59. This efficiently heats the heat exchange unit 55 with the combustion heat.

(12) The fins 63 extended in the direction from the basal end toward the distal end of the tube 21. This limits the gas that remains in the space between the fins 63 when the air-fuel mixture is burned. Thus, the heat exchange unit 55 is further efficiently heated by the combustion heat.

(13) The duty ratios D1 and D2 of the valves 45 and 52 are set taking into consideration the fuel temperature Tf. Thus, the fuel amount supplied to the electric heater 46 and the heat exchange unit 55 is highly accurate relative to the calculated values. This improves the ignitability and the combustibility of the air-fuel mixture.

(14) The meandering flow passage 62 has a larger flow passage cross-sectional area than the second pipe 50. Thus, the pressure of the fuel rapidly decreases when entering the heat exchange unit 55. As a result, the fuel is easily vaporized when flowing into the heat exchange unit 55.

The first embodiment may be modified as described below.

The fins 63 formed on the heat receiving portion 59 may extend in the circumferential direction of the tube 21 as long as the surface area of the heat receiving portion 59 increases.

The fins 63 may be omitted from the heat exchange unit 55.

The heat exchange unit 55 may contact the tube 21 without exposing the heat receiving portion 59 in the combustion chamber 28. In other words, the heating with the combustion heat may be indirectly performed through at least the circumferential wall of the tube 21 in the heat exchange unit 55.

The baffle plates 61 may be omitted from the heat exchange unit 55. In other words, the fuel only needs to be vaporized when passing through the heat exchange unit 55. Further, the flow passage formed in the heat exchange unit 55 is not limited to the meandering flow passage 62.

The flow passage cross-sectional area of the flow passage formed in the heat exchange unit 55 may be smaller than the flow passage cross-sectional area of the second pipe 50. Such a structure increases the heat transmitting efficiency between the fuel and the heat exchange unit as the flow speed of fuel in the flow passage increases. Further, the flow passage cross-sectional area of the flow passage formed in the heat exchange unit 55 may be the same as the flow passage cross-sectional area of the second pipe 50.

The shape of the heat exchange unit 55 may be box-shaped or cylindrical. A cylindrical heat exchange unit may include a fin tube, with an outer circumferential surface on which a fin is formed, or an inner fin tube, in which a fin is arranged. In other words, the heat exchange unit only needs to be able to vaporize the fuel when receiving the fuel heat of the fuel.

The supplied power W of the electric heater 46 may be fixed supplied power that is not changed in accordance with the vaporization amount Qfm1.

In the power data 90, instead of the supplied power W corresponding to the fuel temperature Tf, the supplied power W may be specified using a predetermined fuel temperature Tf as a reference.

In the vaporization amount data 86, instead of the vaporization amount Qfm2 corresponding to the fuel temperature Tf, the vaporization amount Qfm2 may be specified using a predetermined fuel temperature Tf as a reference.

The duty ratios D1 and D2 of the valves 45 and 52 may be set without converting the mass flow rate to the volume flow rate. That is, in the control unit 70, the specific weight data 87 may be omitted, and each piece of duty data may be specified using a predetermined mass flow rate and a predetermined duty ratio.

In the first duty data 88, instead of the duty ratio D1 corresponding to the fuel pressure Pf, the duty ratio D1 may be specified using a predetermined fuel pressure Pf as a reference.

In the second duty data 89, instead of the duty ratio D2 corresponding to the fuel pressure Pf, the duty ratio D2 may be specified using a predetermined fuel pressure Pf as a reference.

The second valve 52 may be controlled to open only when the sum of the vaporization amount Qfm2 is greater than or equal to the fuel supply amount Qfm. That is, the second valve 52 need only be controlled to open only when the heat exchange unit 55 is able to vaporize the fuel.

When the second valve 52 is open, the electric heater 46 may be continuously supplied with predetermined power or the supply of power may be repetitively stopped and started. Such a structure easily maintains the temperature of the electric heater 46. This increases the initial temperature of the electric heater 46 when the supply of power is resumed. The electric heater 46 may be deactivated before the second valve 52 opens or after the second valve 52 opens.

In the burner including the heat exchange units 55, the heat exchange unit temperature sensor 60 may be provided for each heat exchange unit 55, and the duty ratio D2 of each second valve 52 may be controlled based on the detection value of each heat exchange unit temperature sensor 60.

The burner control unit 70 may be a single electronic control unit or be configured by a plurality of electronic control units.

The application of the hot exhaust gas generated by the burner 20 is not limited to the regeneration process of the DPF 12. For example, the hot exhaust gas may be applied to a catalyst temperature raising process that raises the temperature of the catalyst arranged in the exhaust purification device.

The engine to which the burner 20 is applied may be a gasoline engine. The burner 20 is not only applied to an engine and may be applied to, for example, a heating appliance.

Second Embodiment

A burner according to a second embodiment of the present disclosure will now be described with reference to FIGS. 9 to 11. The burner of the second embodiment differs from the burner of the first embodiment in the structures of the premixing chamber and the heat exchange unit. Thus, in the second embodiment, the description will focus on the differences from the first embodiment. Same reference numerals are given to those components that are the same as the corresponding components of the first embodiment. Such components will not be described in detail.

Figure 9:
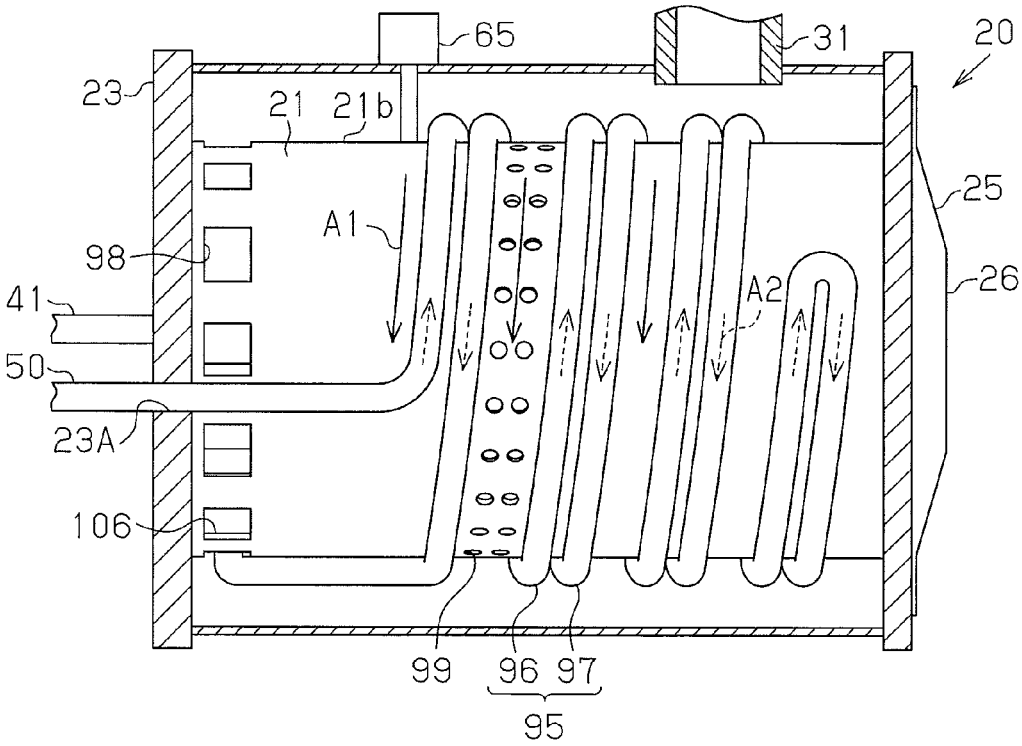
FIG. 9 is a schematic diagram showing the structure of a burner according to a second embodiment of the present disclosure.

As shown in FIG. 9, in the burner 20 of the second embodiment, a single second pipe 50 is branched from the first pipe 41. In the second pipe 50, a downstream portion of the second valve 52 extends into the air intake chamber 33 through a through hole 23A formed in the base plate 23. The second pipe 50 includes a heat exchange unit 95 joined with an outer surface 21*b* of the tube 21. The heat exchange unit 95 is the portion of the second pipe 50 that contacts the outer surface 21*b* of the tube 21 between the ejection port 26 and the vicinity of the spark plug 65. The heat exchange unit 95 includes a forthward passage 96, which is spirally wound in a direction from the base plate 23 toward the ejection port 26, and a backward passage 97, which is bent back from the forthward passage 96 and also spirally wound in a direction toward the base plate 23. The second pipe 50 extends to the lower side of the tube 21 from the distal end of the backward passage 97. Then, the second pipe 50 extends into the tube 21 through a first intake hole 98. The heat exchange unit temperature sensor 60 acquires the temperature at the downstream portion of the heat exchange unit 95 as the main body temperature Th.

In the tube 21, second intake holes 99 that draw air into a combustion chamber 126 are formed in a portion that does not contact the heat exchange unit 95. The second intake holes 99 are spirally laid out like the heat exchange unit 95 of the second pipe 50. The combustion air that flows into the air intake chamber 33 from the air supply pipe 31 flows toward the base plate 23 while swirling around the tube 21 guided by the second pipe 50, which is spirally wound around the outer surface 21*b* of the tube 21. In FIG. 9, the solid line arrow A1 indicates the flow of the combustion air, and the dotted line arrow A2 indicates the flow of fuel flowing through the second pipe 50.

Figure 10:
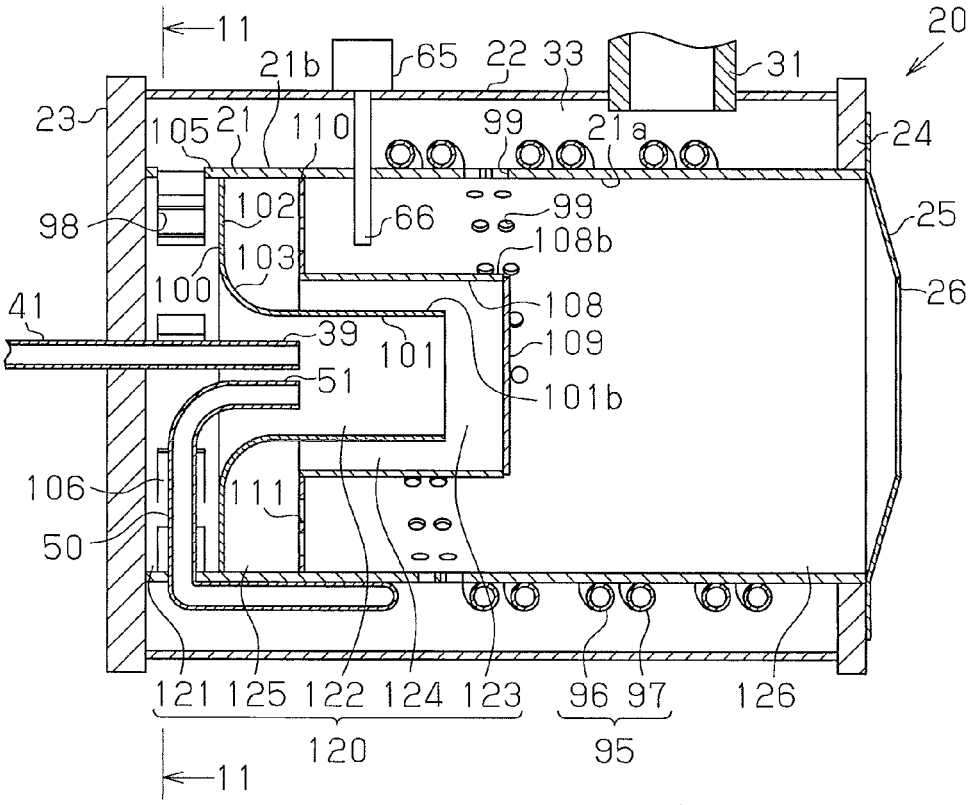
FIG. 10 is a schematic diagram showing the structure of a pre-mixing chamber in the second embodiment.

As shown in FIG. 10, a second pipe 101 having a cylindrical shape is connected to an inner surface 21*a* of the tube 21, which is a first tube, by an annular connecting wall 100, which is a first wall. The connecting wall 100 includes an outer circumference fixed at a position located toward the base plate 23 of the tube 21. The connecting wall 100 closes a gap between the inner surface 21*a* of the tube 21 and the outer surface 101*b* of the second pipe 101. The connecting wall 100 includes a flange portion 102, which is connected to the inner surface 21*a* of the tube 21, and a diameter reduced portion 103, which connects the flange portion 102 and the second pipe 101. The diameter reduced portion 103 is formed to approach the ejection port 26 at locations closer to the second pipe 101. The second pipe 101 extends from a portion coupling to the connecting wall 100 toward the ejection port 26. Further, the second pipe 101 includes an open distal end toward the ejection port 26.

The tube 21 includes an extended portion 105 defined by a portion extending toward the base plate 23 from the portion connecting the tube 21 and the connecting wall 100. The extended portion 105 includes the first intake holes 98 formed in predetermined intervals in the circumferential direction. The first intake holes 98 draws combustion air into a first mixing chamber 121, which is a void surrounded by the extended portion 105. The extended portion 105 includes a bent piece 106 in which a portion of the circumferential wall of the extended portion 105 is bent out toward the inner side from an open edge of the first intake hole 98. The bent piece 106 directs combustion air flowing into the first mixing chamber 121 in the circumferential direction of the tube 21 to generate a swirling flow in the same direction as the swirling direction of the combustion air with the second pipe 50 in the first mixing chamber 121.

The air drawn into the first mixing chamber 121 flows from the side of the base plate 23 into a second mixing chamber 122, which is a void surrounded by the second pipe 101 and the connecting wall 100. A nozzle port of the injection nozzle 39 is arranged in the second mixing chamber 122. The second pipe 50 extends toward the upper side in the first mixing chamber 121 and is then curved toward the ejection port 26. Thus, the nozzle port of the injection nozzle 51 at the downstream end of the second pipe 50 is also located in the second mixing chamber 122.

A third tube 108 having a cylindrical shape is a projecting tube in which a portion of the second pipe 101 is received, and is extended toward the ejection port 26 beyond the second pipe 101. The opening at the distal end of the third tube 108 is closed by a closing plate 109. In other words, the third tube 108 includes a closed end. The basal end closer to the base plate 23 in the third tube 108 is arranged closer to the ejection port 26 than the connecting wall 100, and the basal end is fixed to the tube 21 by way of an annular partition wall 110.

The partition wall 110, which is a second wall, includes an inner circumferential edge connected over the entire circumference of an outer surface 108*b* of the third tube 108. An outer circumferential edge of the partition wall 110 is connected over the entire circumference of the inner surface 21*a* of the tube 21. The partition wall 110 includes a plurality of connecting passages 111 that connect the side of the base plate 23 and the side of the ejection port 26. A metal mesh (not shown) that covers the plurality of connecting passages 111 from the side of the ejection port 26 is attached to the partition wall 110. The igniting portion 66 of the spark plug 65 is arranged closer to the ejection port 26 than the partition wall 110 in the gap of the tube 21 and the third tube 108.

A third mixing chamber 123 is formed closer to the ejection port 26 than the second pipe 101. The third mixing chamber 123 is a void surrounded by the third tube 108 and the closing plate 109, and is in communication with the second mixing chamber 122. A fourth mixing chamber 124 is formed by a gap between the second pipe 101 and the third tube 108. The fourth mixing chamber 124 is in communication with the third mixing chamber 123. A fifth mixing chamber 125 is a void surrounded by the tube 21, the partition wall 110, and the connecting wall 100. The fifth mixing chamber 125 is in communication with the fourth mixing chamber 124 and formed closer to the base plate 23 than the fourth mixing chamber 124.

In other words, a pre-mixing chamber 120 of the burner 20 includes the first to fifth mixing chambers 121, 122, 123, 124, and 125. Further, the combustion chamber 126 includes the gap between the tube 21 and the third tube 108, and the void surrounded by the tube 21 at a location closer to the ejection port 26 than the closing plate 109. A partitioning portion that partitions the interior of the tube 21 into the pre-mixing chamber 120 and the combustion chamber 126 includes the third tube 108, the closing plate 109, and the partition wall 110.

The air-fuel mixture generated in the second mixing chamber 122 flows through the second mixing chamber 122 toward the ejection port 26. The air-fuel mixture is reversed in the third mixing chamber 123 and flows through the fourth mixing chamber 124 in a direction opposite to the flowing direction in the second mixing chamber 122. Then, the air-fuel mixture is reversed again in the fifth mixing chamber 125 and flows into the combustion chamber 126 through the connecting passages 111 of the partition wall 110. The air-fuel mixture that flows into the combustion chamber 126 is ignited by the igniting portion 66 to generate a flame F, which is the burned air-fuel mixture. The flame F generates combustion gas.

Figure 11:
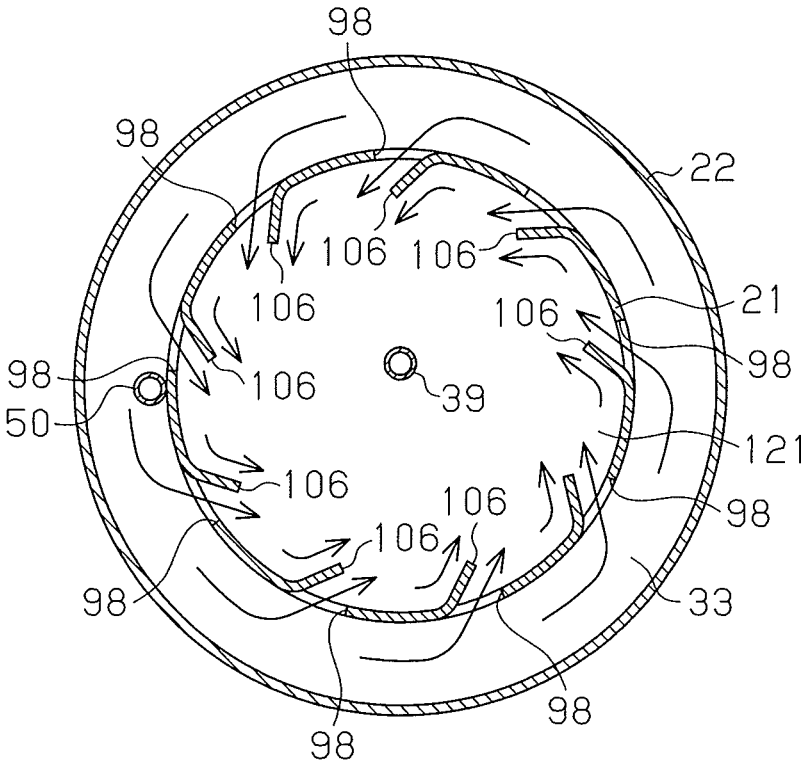
FIG. 11 is a cross-sectional view taken along line 11-11 in FIG. 10.

FIG. 11 is a cross-sectional view showing a cross-sectional structure taken along line 11-11 in FIG. 10. The arrow shown in FIG. 11 roughly shows the flow of the combustion air. As shown in FIG. 11, the bent pieces 106 formed in the extended portion 105 of the tube 21 is arranged to cover the first intake holes 98. The bent pieces 106 guide the combustion air flowing into the first mixing chamber 121 through the first intake hole 98 to generate a swirling flow in the first mixing chamber 121.

The operation of the burner 20 in the second embodiment described above will now be described.

The fuel flowing through the second pipe 50 is vaporized by the combustion heat of the fuel received through the tube 21 in the heat exchange unit 95, and then supplied to the second mixing chamber 122. The heat exchange unit 95 of the second pipe 50 is spirally wound around the outer surface 21*b* of the tube 21. Thus, when connecting two points in the axial direction of the tube 21 with the second pipe 50, the tube passage length is elongated compared to when the two points are connected with a straight second pipe 50. In this manner, the spiral winding of the heat exchange unit 95 around the tube 21 increases the heat quantity the fuel receives when passing through the heat exchange unit 95 and increases the amount of fuel that can be vaporized by the heat exchange unit 95.

The heat exchange unit 95 generates a swirling flow that swirls around the tube 21 by guiding the combustion air. Thus, compared to when the combustion air passes through the air intake chamber 33 without swirling, heat exchange is efficiently performed through the tube 21 between the combustion heat of the fuel and the combustion air. This reduces fuel liquefaction caused by mixing with the combustion air.

In the vicinity of the opening of the second intake hole 99 in the inner surface 21*a* of the tube 21, a circulating flow of the combustion gas including the flame F is generated. The flame stabilizing effect is obtained by the circulating flow. The second intake holes 99 are formed at a plurality of positions in the axial direction of the tube 21 when spirally laid out. In other words, the flame stabilizing effect with the circulating flow described above is obtained at a plurality of positions in the axial direction of the tube 21. This improves the combustibility of the air-fuel mixture.

The combustion chamber 126 surrounds a portion of the fourth mixing chamber 124 and the third mixing chamber 123, which form a portion of the pre-mixing chamber 120. Thus, compared to when the pre-mixing chamber 120 and the combustion chamber 126 are arranged next to each other in the axial direction of the tube 21 like in the first embodiment, the circumferential wall of the combustion chamber in the tube 21, that is, the portion that directly receives the combustion heat of the fuel is a major part. As a result, this increases the flexibility for the layout of the second pipe 50 when a portion of the second pipe 50 contacts the tube 21.

As described above, the second embodiment has the following advantages in addition to advantages (1), (2), (4) to (9), and (13) of the first embodiment.

(15) The heat exchange unit 95 is spirally wound around the outer surface 21*b* of the tube 21. As a result, the heat quantity receives by the fuel flowing through the heat exchange unit 95 increases. This increases the amount of fuel that can be vaporized by the heat exchange unit 95.

(16) The combustion air is swirled around the tube 21 by the heat exchange unit 95. This reduces the liquefaction of the fuel caused by mixing with the combustion air.

(17) The second intake holes 99 are spirally laid out so that the flame stabilizing effect is obtained at a plurality of positions in the axial direction of the tube 21. This increases the flexibility for the layout of the heat exchange unit 95 in the second pipe 50.

(18) The combustion chamber 126 surrounds a portion of the fourth mixing chamber 124 and the third mixing chamber 123, which is a portion of the pre-mixing chamber 120. This efficiently heats the heat exchange unit 95 with the tube 21.

The second embodiment may be modified as described below.

For example, in the burner 20 of the second embodiment, the connecting wall 100 and the second pipe 101 may be omitted from the burner, and the partition wall 110 may be changed to one without the connecting passages 111. Further, connecting holes may be formed in the circumferential wall of the third tube 108. In such a structure, a portion of the pre-mixing chamber 120 is also surrounded by a portion of the combustion chamber 126.

The second intake holes 99 do not have to be spirally arranged. Further, a portion of the opening of the outer surface 21*b* may be covered by the heat exchange unit 95.

The heat exchange unit 95 does not have to be spirally wound around the tube 21. The heat exchange unit 95 is the portion that contacts the tube 21 in the second pipe 50. Thus, the heat exchange unit 95 may include a portion that contacts the tube 21 along the axial direction of the tube 21. Alternatively, the heat exchange unit 95 may include a portion that contacts the tube 21 in the circumferential direction of the tube 21.

The heat exchange unit 95 is laid out in the direction from the basal end toward the distal end of the tube 21, and then bent back and again laid out toward the basal end. Instead, the heat exchange unit 95 may just be laid out in the direction from the distal end toward the basal end of the tube 21.

The heat exchange unit 95 of the second pipe 50 may have at least one of the forthward passage 96 and the backward passage 97 joined to the inner surface 21*a* instead of the outer surface 21*b* of the tube 21. In this case, when joining one of the forthward passage 96 and the backward passage 97, for example, only the backward passage 97, to the inner surface 21*a*, the backward passage 97 is wound around the inner surface 21*a* so that the fuel in the backward passage 97 flows in the direction opposite to the swirling direction of the combustion air in the pre-mixing chamber 120. This is because the swirling flow of the combustion gas is generated even in the combustion chamber 126 by the swirling of the air-fuel mixture in the pre-mixing chamber 120. In such a structure, countercurrent type heat exchange is performed in the heat exchange unit 95. Thus, fuel is efficiently heated by the combustion heat of the fuel. The backward passage 97 in which the temperature difference of the fuel and the combustion gas is smaller than that in the forthward passage 96 is preferably joined to the inner surface 21*a*.

The heat exchange unit 55 described in the first embodiment may be arranged in the middle of the heat exchange unit 95. In such a structure, the vaporization amount in the heat exchange unit increases compared to when the heat exchange unit is either the heat exchange unit 55 or the heat exchange unit 95. This further increases the consumed power of the electric heater 46.

DESCRIPTION OF REFERENCE NUMERALS

10 diesel engine
11 exhaust pipe
12 DPF
13 intake pipe
14 turbine
15 compressor
20 burner
21, 22 tube
23 base plate
23A through hole
24 closing plate
25 ejection plate
26 ejection port
27 pre-mixing chamber
28 combustion chamber
29 partition wall
30 connecting passage
31 air supply pipe
32 air valve
33 air intake chamber
34 first intake hole
35 second intake hole
39 injection nozzle
40 fuel tank
41 first pipe
42 fuel pump
43 fuel pressure sensor
44 fuel temperature sensor
45 first valve
46 electric heater
47 power supply device
50 second pipe
51 injection nozzle
52 second valve
55 heat exchange unit
56 attaching base
57 main body
58 attaching flange
59 heat receiving portion
60 heat exchange unit temperature sensor
61 baffle plate
62 meandering flow passage
63 fin
65 spark plug
66 igniting portion
70 burner control unit
71 upstream side exhaust gas flow rate sensor
72 upstream side exhaust gas pressure sensor
73 upstream side exhaust gas temperature sensor
74 DPF temperature sensor
75 downstream side exhaust gas pressure sensor
76 intake air amount sensor
77 air flow amount sensor
78 air temperature sensor

81 valve control section
82 power control section
85 memory
86 vaporization amount data
87 specific weight data
88 first duty data
89 second duty data
90 power data
95 heat exchange unit
96 forthward passage
97 backward passage
98 first intake hole
99 second intake hole
100 connecting wall
101 second pipe
102 flange portion
103 diameter reduced portion
105 extended portion
106 bent piece
108 third tube
109 closing plate
110 partition wall
111 connecting passage
120 pre-mixing chamber
121 first mixing chamber
122 second mixing chamber
123 third mixing chamber
124 fourth mixing chamber
125 fifth mixing chamber
126 combustion chamber

The invention claimed is:

1. A burner comprising:

a combustion unit that burns fuel;

a first supply unit that includes an electric heater, which heats fuel to be supplied to the combustion unit and supplies the fuel heated by the electric heater to the combustion unit, a second supply unit that includes a heat exchange unit, which converts heat of the combustion unit to vaporization heat of the fuel, wherein the second supply unit supplies the fuel heated by the heat exchange unit to the combustion unit; and a controller that controls driving of the first supply unit and driving of the second supply unit, wherein the electric heater and the heat exchange unit are connected in parallel to the combustion unit, wherein the controller includes a temperature acquisition portion that acquires a temperature of the heat exchange unit, and a memory that stores vaporization amount data that specifies a maximum value of a fuel amount vaporizable in the heat exchange unit in correspondence with the temperature of the heat exchange unit, wherein when the maximum value corresponding to the acquired temperature is greater than or equal to a fuel amount supplied to the combustion unit, the controller is configured to stop heating with the electric heater and to supply fuel with the second supply unit, when the maximum value corresponding to the acquired temperature is smaller than the fuel amount supplied to the combustion unit, the controller is configured to supply fuel with the second supply unit and supply fuel with the first supply unit.

2. The burner according to claim 1, wherein the memory is configured to store power data in which the fuel amount vaporizable by the electric heater is specified in correspondence with the power of the electric heater; and the controller is configured to drive the electric heater with power corresponding to an amount of fuel supplied by the first supply unit.

3. The burner according to claim 1, wherein the combustion unit includes a tube that forms a circumferential wall of a combustion chamber, which is a void in which the fuel is burned; and the heat exchange unit is attached to the tube and includes a heat receiving portion that is exposed in the combustion chamber to receive combustion heat of the fuel.

4. The burner according to claim 3, wherein the tube includes a basal end, which is supplied with fuel prior to burning, and a distal end, from which combustion gas generated when burning the fuel flows out; and the heat receiving portion includes a plurality of fins extending in a direction from the basal end toward the distal end and arranged next to each other in a circumferential direction of the tube.

5. The burner according to claim 1, wherein the combustion unit includes a tube that forms a circumferential wall of the combustion chamber, which is a void in which the fuel is burned; and the heat exchange unit includes a tube passage that contacts the tube.

6. The burner according to claim 5, wherein the tube passage includes a portion spirally wound around the tube.

7. The burner according to claim 6, further comprising an outer tube, into which the tube is inserted, wherein air is supplied to a gap between the outer tube and the tube.

8. The burner according to claim 6, wherein the tube includes a plurality of intake holes that draw air into the combustion chamber, and the intake holes are spirally laid out at a portion that does not contact the tube passage.

9. The burner according to claim 5, wherein the tube includes a basal end, which is supplied with fuel prior to burning, and a distal end, from which combustion gas generated when burning the fuel flows out;

the combustion unit includes a partitioning portion that partitions an interior of the tube into a pre-mixing chamber, in which an air-fuel mixture of the fuel and air is generated, and a combustion chamber, in which the air-fuel mixture is burned; and the partitioning portion includes an annular wall including an outer edge connected to an inner surface of the tube, and a projecting tube that projects from an inner edge of the wall toward the distal end of the tube, wherein the projecting tube includes a closed end located closer to the distal end than the outer edge of the wall.

* * * * *